US005288256A

United States Patent [19]

Lee et al.

[11] Patent Number: 5,288,256

[45] Date of Patent: Feb. 22, 1994

[54] THROWN WATER PROPELLING AND DISPENSING TOY

[75] Inventors: James S. W. Lee, Long Island, N.Y.; Chiu-Keung Kwan, Kowloon, Hong Kong

[73] Assignee: C.J. Associates, Ltd., Kowloon, Hong Kong

[21] Appl. No.: 980,566

[22] Filed: Nov. 23, 1992

[51] Int. Cl.[5] ..... A63H 27/00; A63H 3/52; B05B 1/00; A63B 65/02

[52] U.S. Cl. ..... 446/48; 446/267; 446/475; 222/78; 239/211; 239/289; 273/58 H; 273/418

[58] Field of Search ..... 446/34, 46, 47, 48, 446/267, 475, 483, 211; 222/78; 239/211, 289, 214; 273/58 H, 349, 424, 425, 428, 418

[56] References Cited

U.S. PATENT DOCUMENTS

| | | | |
|---|---|---|---|
| 2,703,087 | 3/1955 | Newmark | 446/267 X |
| 3,848,808 | 11/1974 | Fetty et al. | 222/78 X |
| 3,855,728 | 12/1974 | Hynds | 273/424 X |
| 3,878,639 | 4/1975 | Scheelar et al. | 446/475 X |
| 3,965,611 | 6/1976 | Pippin, Jr. | 446/211 |
| 4,078,792 | 3/1978 | Areto | 239/211 X |
| 4,207,702 | 6/1980 | Boatman et al. | 446/48 |
| 4,274,591 | 6/1981 | Sunshine et al. | 446/211 X |
| 4,335,536 | 6/1982 | Magid et al. | 446/46 |
| 4,991,847 | 2/1991 | Rudell et al. | 273/58 H X |
| 5,080,625 | 1/1992 | Huffhines | 446/475 X |

*Primary Examiner*—David N. Muir
*Attorney, Agent, or Firm*—Laff, Whitesel, Conte & Saret

[57] ABSTRACT

A thrown toy has a water tank with valves which are opened by centrifugal force. When thrown, the toy is designed to whirl so that the centrifugal force opens a valve and water is dispersed out the valves while the toy is in flight.

13 Claims, 3 Drawing Sheets

THROWN WATER PROPELLING AND DISPENSING TOY

BACKGROUND OF THE INVENTION

This invention relates to water propelling and dispersing toys and more particularly to thrown toys which trail a stream of water as they fly through the air.

For convenience of description, the term "thrown toy" is used hereinafter to generically describe the invention as any suitable device. The structure of the invention will be described hereinafter as a flying disk; however, it should be understood that this description does not limit the invention to this specific structure. Many toys are adapted to be thrown through the air, a few examples of which are balls, disks, rings, boomerangs, or the like.

These and similar thrown toys have a universal appeal going back through time, perhaps to the first person who threw something as a matter of entertainment or sport. Therefore, it is difficult to imagine how any improvement could be made to toys of this type at this late date. On the other hand, in view of the great appeal for throwing things, it is also apparent that new and novel thrown toys are attractions which are often sought.

Accordingly, an object of this invention is to provide new and novel thrown toys. In particular, an object of the invention is to provide thrown toys in combination with a device for dispersing water as the toy flies through the air. Another object of the invention is to provide a safe toy which does minimum damage if it strikes a person or an unintended target.

SUMMARY OF THE INVENTION

In keeping with an aspect of the invention, these and other objects are accomplished by a thrown toy having a structure with three principal parts. Two of these parts are upper and lower members which are cemented or ultrasonically welded together, for example, in order to form a toroidal water tank. The third part includes a soft sponge covering which snaps on over the water tank in order to prevent damage if the thrown toy strikes a person or an unintended object. The water tank includes at least one spring biased valve having a construction which responds to centrifugal forces. Among the force responsive means is a weight which also acts as an orifice shutter. When the toy is thrown, the centrifugal force acting on the weight and on the water in the tank, moves the orifice shutter against the spring bias to release water from the tank. Before the toy is thrown or after the toy lands there is no centrifugal force, and the spring bias closes the valve to terminate the flow of water.

BRIEF DESCRIPTION OF THE DRAWINGS

A preferred embodiment of the thrown toy is shown in the attached drawings, in which.

DESCRIPTION OF THE PREFERRED EMBODIMENT

Figure 1:
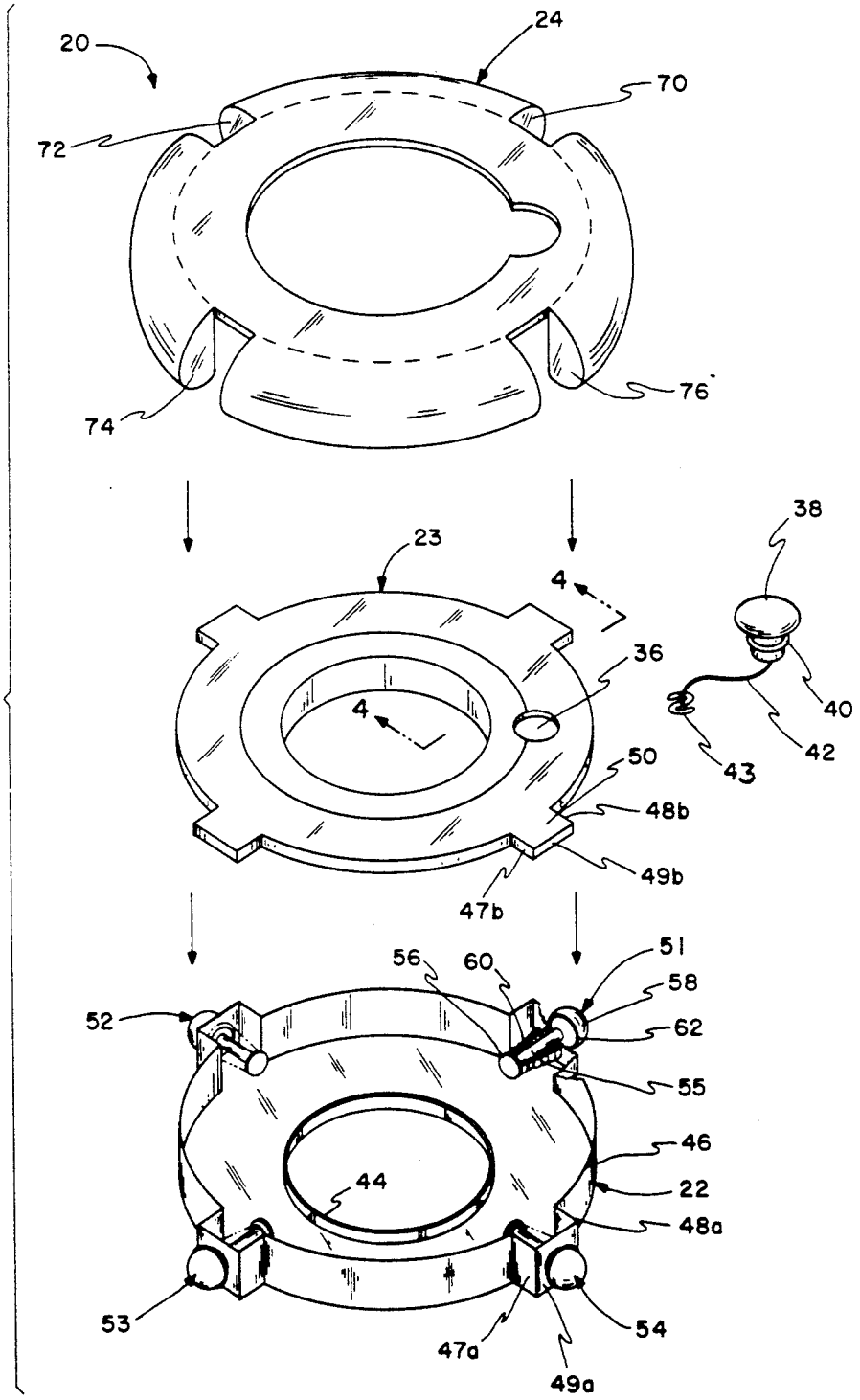
FIG. 1 is an exploded view of the inventive thrown toy.
Figure 3:
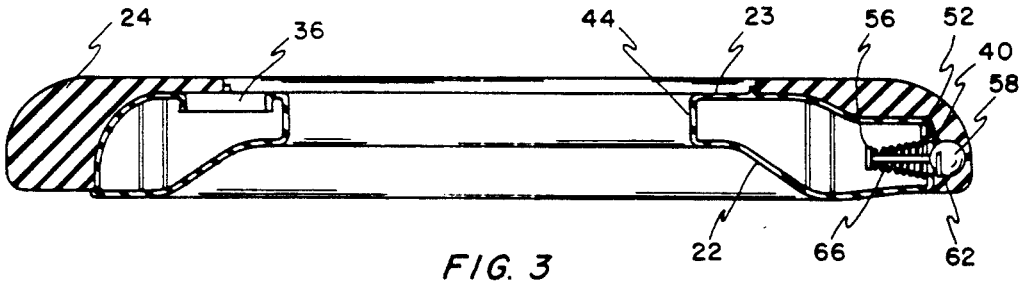
FIG. 3 is a cross section taken along line 3—3 of FIG. 2.
Figure 2:
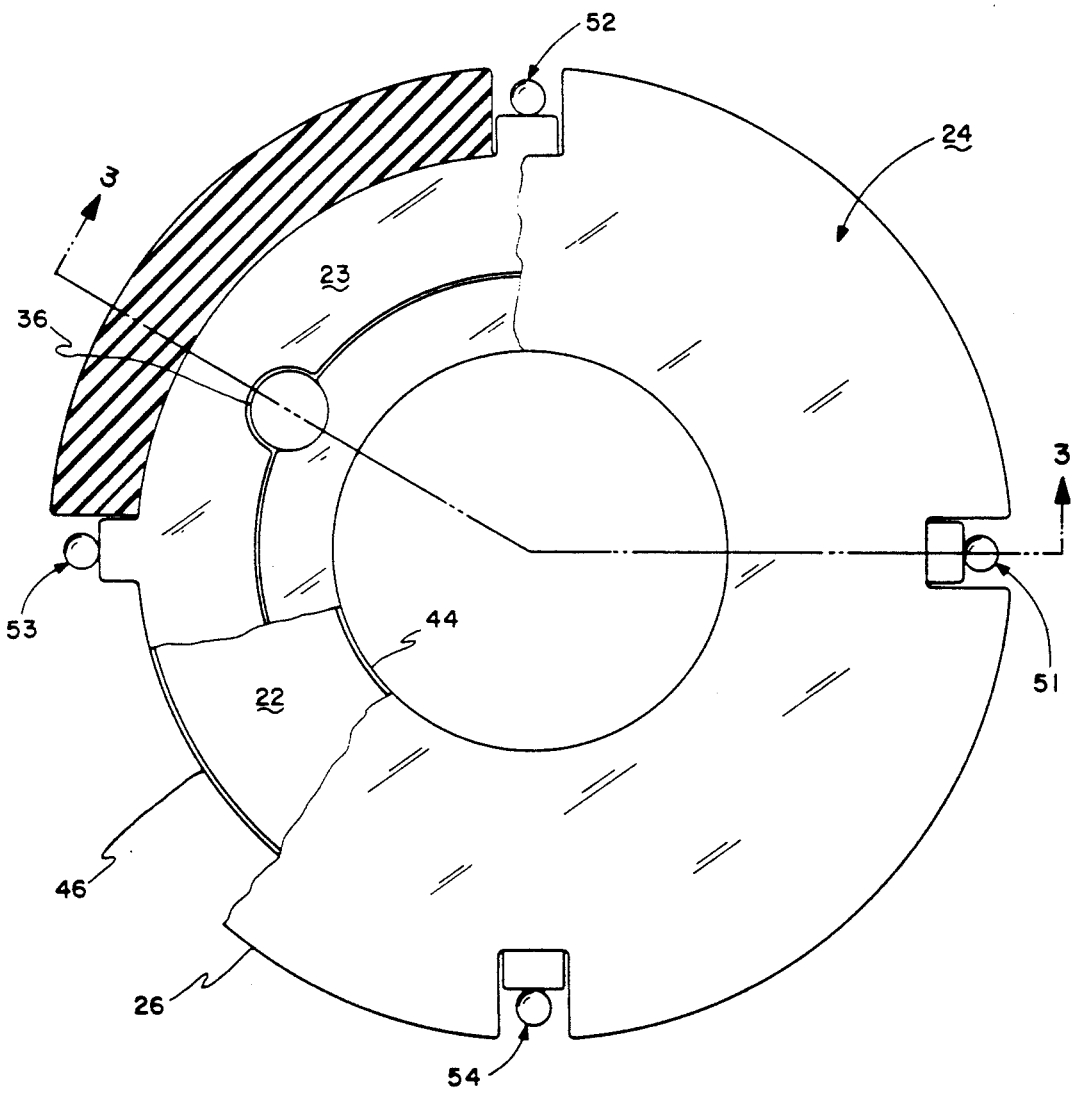
FIG. 2 is a plan view of the toy, partially broken away to show the assembled toy of FIG. 1.
Figure 4:
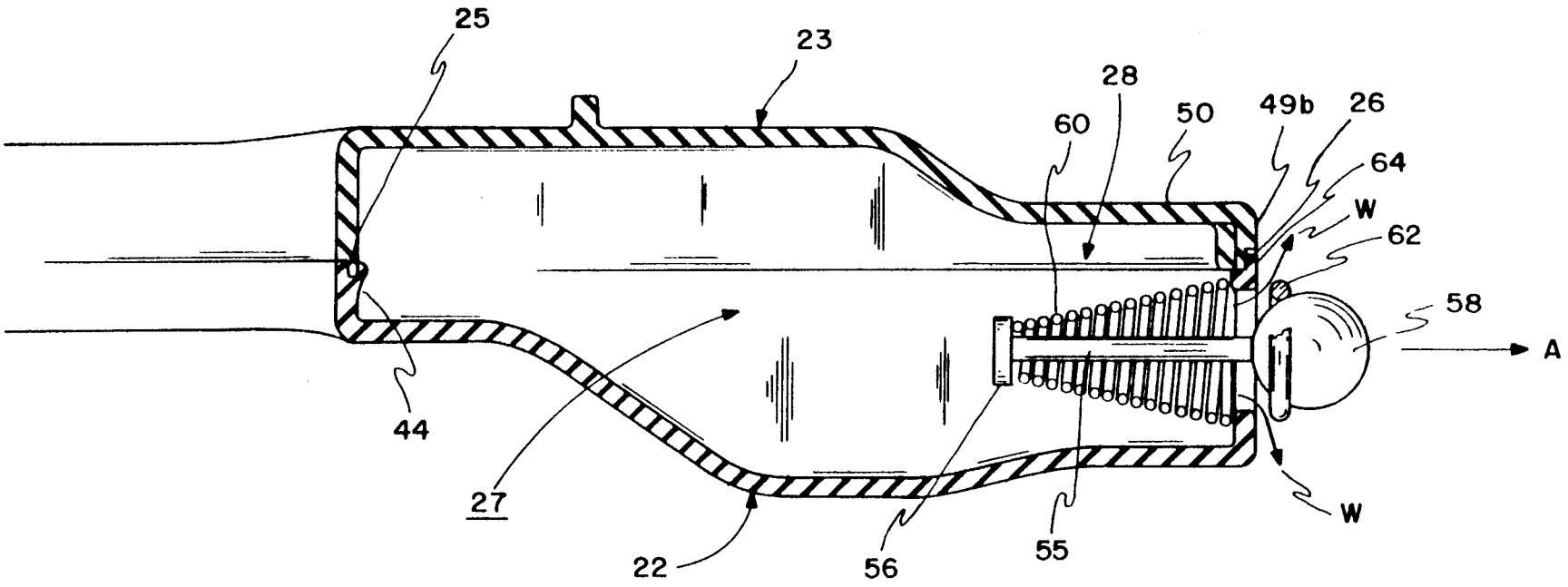
FIG. 4 is a cross section of the water tank and a valve, taken along line 4—4 of FIG. 1.

The thrown toy 20 (FIG. 1) includes three principal parts, a toroidal lower half 22 of a water tank, a toroidal upper half 23 of the water tank, and a soft cover 24, which cushions the blow if the toy strikes a person or an unintended object. The two tank halves 22, 23 (preferably made of a hard plastic) are joined to each other in a face to face contact by any suitable sealing means, such as cement, sonic or thermal welding, as at 25, 26 (FIG. 4) in order to form a toroidal water tank 27. The soft sponge like cover 24 (FIG. 1) snaps on over the water tank 27.

In addition to these three principal parts, a water inlet 36 provides means for filling the water tank 27. A cap 38 has an O-ring 40 for closing and sealing the opening 36. A string or other cord 42 attaches a plastic spring anchor 43 to cap 38. Spring 43 fits into but cannot be removed from opening 36 so that, while the cap 38 may be pulled from hole 36, it may not be separated from the toy. Thus, the water tank may be filled by removing the cap 38, without a danger of losing it.

The lower tank half 22 includes upstanding collars 44, 46 defining concentric inner and outer tank walls, respectively. The outer tank wall 46 has any suitable number (here four) of projecting box-like valve compartments formed therein. Each valve compartment comprises a box-like structure having spaced parallel side walls 47*a*, 48*a* and an end wall 49*a*. The upper tank half 24 includes a matching box-like structure having corresponding walls 47*b*, 48*b*, 50*b*.

The toy 20 includes any suitable number of water valves 51, 52, 53, 54, here four valves are shown by way of example. Each valve (e.g., 51) comprises an elongated shaft 55 having a flat spring support plate 56 on one end and a shutter or ball valve weight 58 on the other end. A spring 60 is mounted on shaft 55 and extends between the spring support plate 56 and the forward wall 49 valve of the compartment. An O-ring 62 is embedded in one end of the ball valve 58 to rest against a valve seat 64 under the urging of spring 60. If the toy is thrown in a manner which makes it whirl, valve shutter 58 moves against the urging of spring 60 and in direction A (FIG. 4), so that water W,W (FIG. 4) escapes from tank 27. When the whirling stops and the centrifugal force disappears, spring bias reasserts itself, the ball valve 58 is drawn back against its valve seat 64 to terminate the water flow.

The soft sponge-like cover 24 has notches 70, 72, 74, 76 formed therein to enable the valves 51–54 to disperse water from the tank 27 and out into the ambient air.

In operation, the toy 20 is held in a horizontal orientation and thrown, like a flying disk is thrown. The disk whirls as it travels through the air. The centrifugal forces generated by the whirling of the disk press water against the spring support plate 56 and slings the weight of the ball 58 outwardly from the valve seat 64. As a result, water W,W is flung outwardly from the disk as long as it is whirling and traveling over a trajectory through the air. Before the toy is thrown or after it stops whirling upon impact or when caught, the valves are closed by their individually associated springs so that no water leaves the tank 27.

Those who are skilled in the art will readily perceive how to modify the invention. Therefore, the appended claims are to be construed to cover all equivalent structures which fall within the true scope and spirit of the invention.

The claimed invention is:

1. A thrown water toy comprising a water tank having at least one valve therein, the valve having spring means for normally urging said valve to a closed position, the valve having associated means responsive to centrifugal forces for acting against said spring means and opening said valve.

2. The toy of claim 1 and spongelike means covering at least part of said water tank for absorbing a force of a blow caused by said toy coming to rest after having been thrown.

3. The toy of claim 2 wherein said toy has a disk shape so that it may be thrown with a whirling motion.

4. The toy of claim 3 wherein said water tank has at least one box-like valve compartment formed therein and projecting therefrom, said valve comprising a shaft slidably passing through said valve compartment and having spring support on one end and a ball shutter on the other end, a compression spring mounted on said shaft and extending from said spring support to an inside wall of said valve compartment whereby said spring urges said ball shutter against a valve seat in order to close said valve, said spring support and said ball shutter being acted upon by centrifugal force to sling said ball shutter away from said valve seat and open said valve.

5. The toy of claim 4 wherein said toy is a disk and there are four of said valve compartments and valves, and said spongelike cover has notches therein for enabling water to be flung outwardly from said valves as said disk whirls.

6. A water disk comprising an upper and a lower compartment sealed in face to face contact in order to form a water tank, a plurality of valve areas formed in said water tank, each of said valve areas having a shaft mounted therein to open or close a valve responsive to a centrifugal force, a spring support plate, a ball valve shutter, and spring means associated with said spring support plate for pulling said ball valve shutter against a valve seat in said valve area, said spring means exerting an amount of spring bias which is overcome by centrifugal force when the disk is thrown with a whirling motion.

7. The water disk of claim 6 and a soft spongelike material covering said water tank.

8. The water disk of claim 7 and an O-ring surrounding a part of said ball valve shutter in an area where said ball valve shutter engages said valve seat.

9. The water disk of claim 6 and an opening in said tank for receiving water, a cap for closing said opening, and cord means secured to said cap and anchored in said tank for enabling said cap to be removed from said opening without danger of losing said cap.

10. A toy comprising an upper toroidal hard plastic member having a fill opening therein, a lower hard plastic toroidal member, said upper and lower toroidal members being sealed together in a face to face contact in order to form a water tank, said tank having a periphery, four box-like radial projections on said water tank, said projections being separated from each other by approximately a 90° displacement around the periphery of the tank, each of said projections having a hole surrounded by a valve seat, valve means closing said valve seat, said valve means comprising a shaft slidably mounted in said hole and having a spring seat on one end and means for closing and opening said valve seat on the other end, and a spring on said shaft and positioned between said spring set and said valve seat for urging said means for closing and opening said valve seat to a closed position, the bias of said spring being such that centrifugal force urges said means for closing and opening said valve seat to an open position.

11. The toy of claim 10 and a soft spongelike covering snapped over said water tank, said covering having opening for releasing water when said means for closing and opening said valve means is in an open position.

12. A thrown water toy comprising:

a water tank having at least two opposed valves therein;

means for normally urging said valves to a closed position; and mass means associated with said urging means for experiencing centrifugal force when said water tank is thrown with a whirling motion;

said mass means opening said valves in response to said centrifugal forces, whereby said valves are opened only when said water tank is thrown with a whirling motion.

13. A thrown water toy comprising:

a water tank having at least one valve therein;

said valves being substantially symmetrically arranged about a preferred axis of rotation;

means for normally urging said valve to a closed position;

and means associated with said valve for opening said valve in response to rotation of said water tank about said axis of rotation when said toy is thrown with a whirling motion.

* * * * *